United States Patent [19]

Michael et al.

[11] Patent Number: 4,656,398

[45] Date of Patent: Apr. 7, 1987

[54] LIGHTING ASSEMBLY

[76] Inventors: Anthony J. Michael, 4205 Adobe Dr., Tallahassee, Fla. 32303; James E. Nelson, 515 W. Beechdale, Union Lake, Mich. 48085

[21] Appl. No.: 803,302

[22] Filed: Dec. 2, 1985

[51] Int. Cl.[4] ..... F21V 23/00; F21S 1/04

[52] U.S. Cl. ..... 315/293; 315/76; 315/133; 315/326; 362/285; 362/404; 362/800

[58] Field of Search ..... 315/293, 133, 362, 363, 315/32, 35; 362/285, 800, 404

[56] References Cited

U.S. PATENT DOCUMENTS 2,498,943 2/1950 Courtney ..... 315/32

2,802,144 8/1957 Spear ..... 315/292

4,414,617 11/1983 Galindo ..... 362/285

4,484,105 11/1984 Kriete et al. ..... 315/133

4,591,953 5/1986 Oram ..... 362/285

*Primary Examiner*—Harold Dixon

*Attorney, Agent, or Firm*—Krass & Young

[57] ABSTRACT

A lighting assembly including a plurality of housing sections, a series of rib groups arranged circumferentially on the exterior of the housing sections, and a remote control assembly for selectively energizing tricolor diodes embedded in the ribs so that the rib groups can be selectively and independently caused to glow in various colors depending on the aspect of the electrical energy delivered to each particular rib group.

21 Claims, 16 Drawing Figures

72
74
76
64
78
10
22
84
12
14
18
20
48
40
84
62
60
54
50
60
62
16

80
82
32
78
76
74
66
64
30
24
40
26
86
48
88
84
12
54
14
52
34
54
16
60
62

LIGHTING ASSEMBLY

BACKGROUND OF THE INVENTION

This invention relates to lighting assemblies, and more particularly, to versatile or multi-purpose lighting assemblies.

The typical lighting assembly is generally limited to a specific size, function, appearance and application. Whereas various attempts have been made to provide lighting assemblies offering versatility, none of these fixtures has achieved widespread commercial success because of one or more shortcomings. Specifically, the prior art attempt at versatility has resulted in lighting assemblies that were unduly expensive to manufacture; or have resulted in lighting assemblies that were ungainly in appearance; or have resulted in lighting assemblies that have failed to provide adequate lighting in all intended applications; or have resulted in lighting assemblies that were flimsy in construction and therefore shortlived.

SUMMARY OF THE INVENTION

This invention provides a lighting assembly which is inexpensive to manufacture; which is usable in a wide variety of lighting applications; which offers a variety of custom appearance combinations and a variety of visual effects; and which provides an aesthetically pleasing apprarance in all intended applications and in all available custom combinations.

According to an important feature of the invention, the invention lighting assembly includes an overhead track; a housing; an adapter associated with an upper portion of the housing and received in the track so as to mount the housing for selective axial positioning along the track; a light-emitting assembly mounted on the housing and operative in response to receipt of electrical energy in selected disparate aspects to respectively emit disparate components of the visible light spectrum; a remote control device; and means operative to transmit electrical energy in disparate aspects from the remote control device to the light-emitting assembly via the track and via the adapter so as to remotely and selectively cause the light-emitting assembly to emit disparate aspects of the visible light spectrum.

According to a further aspect of the invention, the transmitting means includes a plurality of contact strips extending along the track; a plurality of contacts on the adapter respectively contacting the strips; means for selectively energizing select combinations of the strips and thereby selected combinations of the contacts; and means for conducting electrical energy from the respective energized contacts of the adapter to the light-emitting assembly.

According to a further feature of the invention, the light-emitting assembly includes a translucent member mounted on the exterior of the housing and at least one light-emitting diode embedded in the translucent member, and electrical conductors extend from the adapter to the light emitting diode.

According to a further feature of the invention, the light-emitting diode is a tricolor light-emitting diode; and the transmitting means is operative to transmit direct current, reverse direct current, and alternating current to the diode through the electrical conductors in response to selective actuation of the remote control device so that the translucent member on the exterior of the housing may be caused to selectively glow in a selective plurality of colors.

According to a further feature of the invention, the translucent member comprises a vertically oriented rib arranged on the exterior of the housing and a plurality of vertically spaced light-emitting diodes are embedded in the rib to provide illumination for the entire vertical height of the rib.

According to a further feature of the invention, a plurality of ribs are arranged in circumferentially spaced relation about the housing so as to provide illumination about the entire circumference of the housing.

According to a further feature of the invention, the housing includes a plurality of vertically spaced sections and a plurality of circumferentially spaced ribs are provided about each of the plurality of housing sections so as to provide multicolor selective illumination throughout the entire circumference and the entire vertical extent of the multisection housing.

DETAILED DESCRIPTION OF THE PREFERRED EMBODIMENTS

Figure 1:
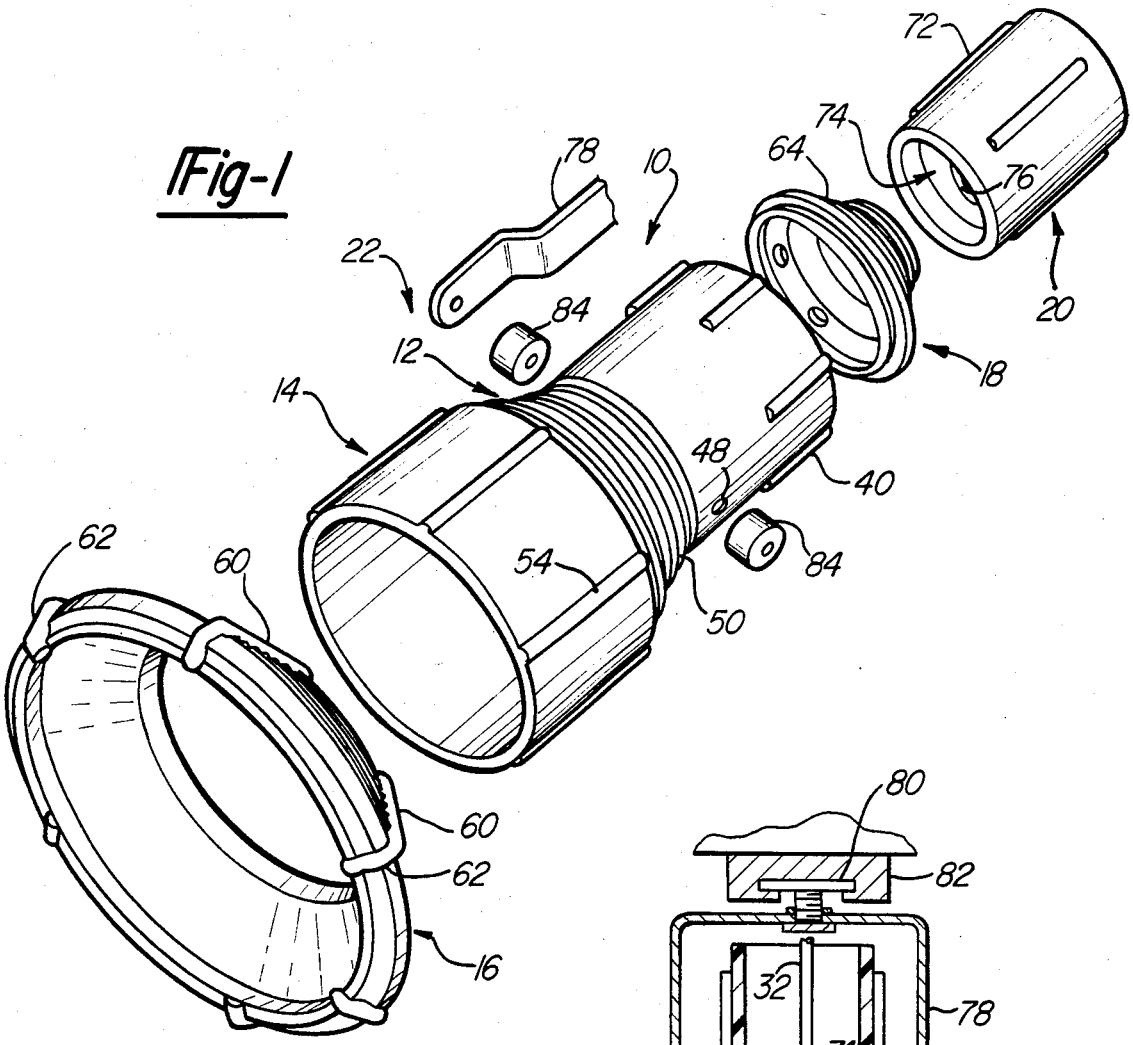
FIG. 1 is an exploded perspective view of a housing assembly for use with the invention lighting assembly.

The invention lighting assembly is intended for use with a lighting fixture of the type disclosed in U.S. patent application Ser. No. 668,732, filed Nov. 6, 1984 and seen generally in FIGS. 1 and 2. The lighting fixture seen in FIGS. 1 and 2 includes a main body cylindrical portion 10; a central conical portion 12 flaring outwardly from the lower end of the main body portion; a lower cylindrical portion 14 extending downwardly from the lower end of central conical portion 14; a lower conical portion 16 flairing outwardly from the lower end of lower cylindrical portion; 14; an upper conical portion 18 extending upwardly and inwardly from the upper end of main body portion 10; and an upper cylindrical portion 20 extending upwardly from the upper end of conical portion 18.

Main body cylindrical portion 10, central conical portion 12, and lower cylindrical portion 14 are formed as an integral molded unit and together comprise a main housing section 22.

Lower conical portion 16, upper conical portion 18, and upper cylindrical portion 20 are formed as separate units or sections, and the various sections are removably secured together by suitable coacting threaded means. A partition 24 formed integrally with main body cylindrical portion 10 provides a mounting means for a lightbulb socket 26. Partition 24 includes a central opening for receipt of a suitable fastener member 30 which mounts socket 26 within portion 10 in a position extending and opening downwardly generally on the central vertical axis of the lighting fixture. An electrical cord 32 extends upwardly from socket 26 through fastener 30 for connection with a suitable electrical outlet and a bulb 34 is conventionally secured within socket 26 and extends downwardly within main housing section 22.

A series of circumferentially spaced vertically extending ribs 72 are provided on the exterior surface of upper cylindrical portion 20; a series of circumferentially spaced vertically extending ribs 40 are provided on the upper exterior surface of the main body cylindrical portion 10; a series of circumferentially spaced vertically extending ribs 54 are provided on the exterior surface of lower cylindrical portion 14; a series of circumferentially spaced vertically extending ribs 60 are provided on the exterior surface of lower conical portion 16 in respective vertical alignment with ribs 54; and a series of circumferentially spaced angled corner ribs 62 are provided around the lower annular edge of lower conical portion 16 in respective vertical alignment with ribs 60.

Figure 2:
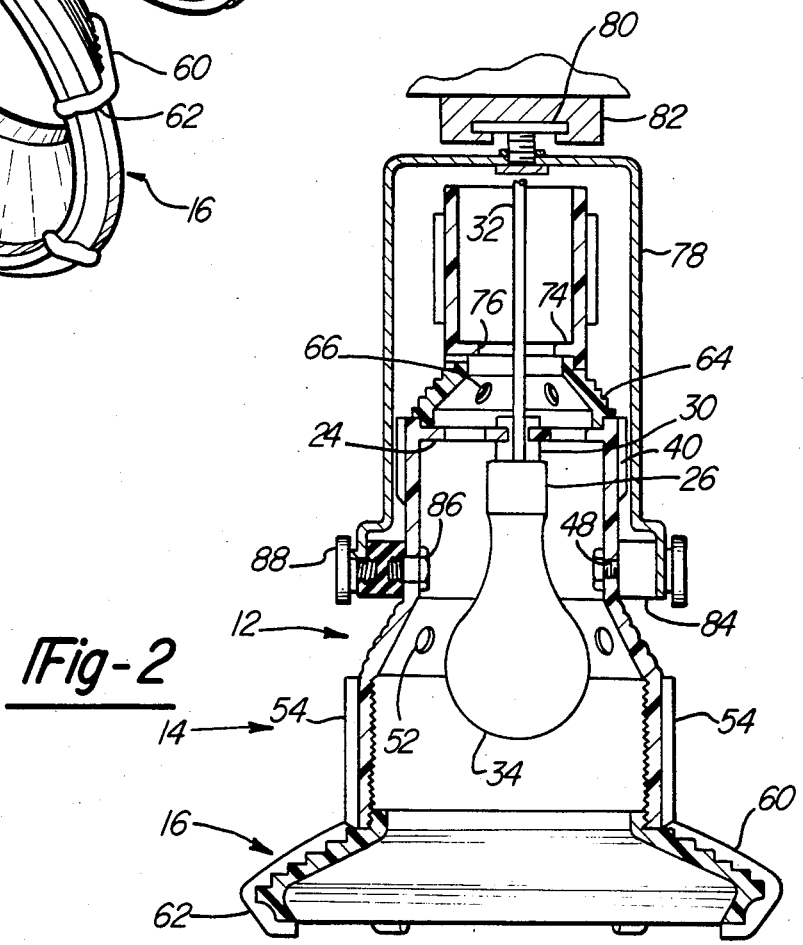
FIG. 2 is a vertical cross-sectional view of the housing assembly of FIG. 1.
Figure 3:
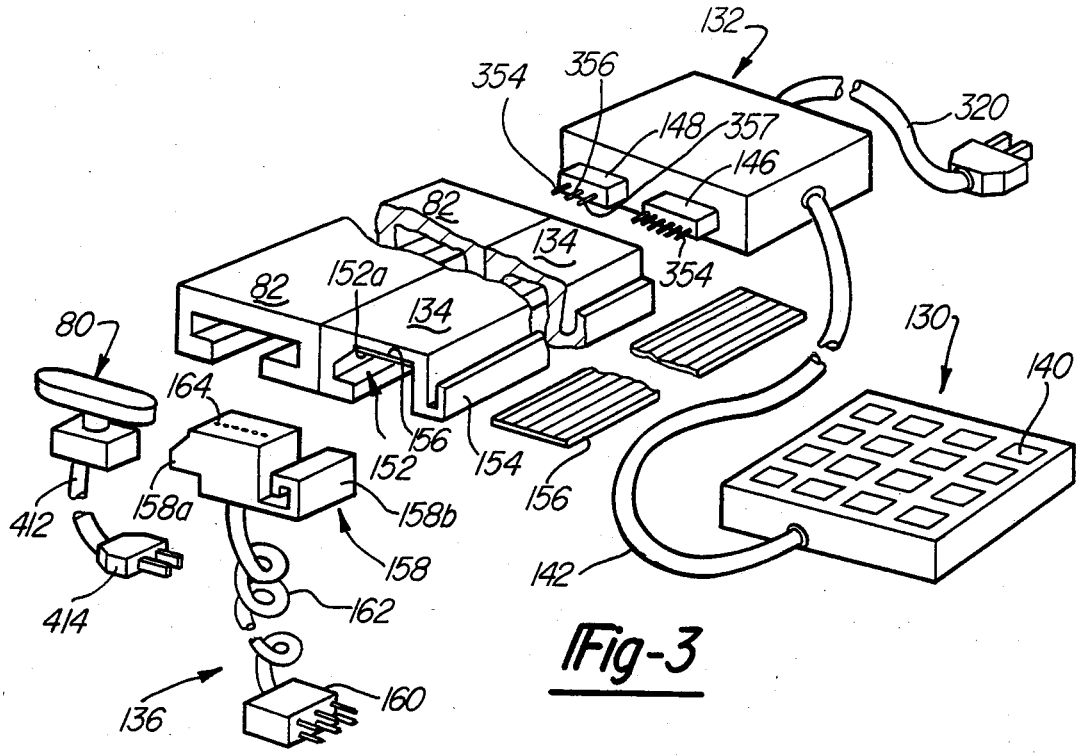
FIG. 3 is a fragmentary perspective view of a control assembly for use with the invention lighting assembly.
Figure 4:
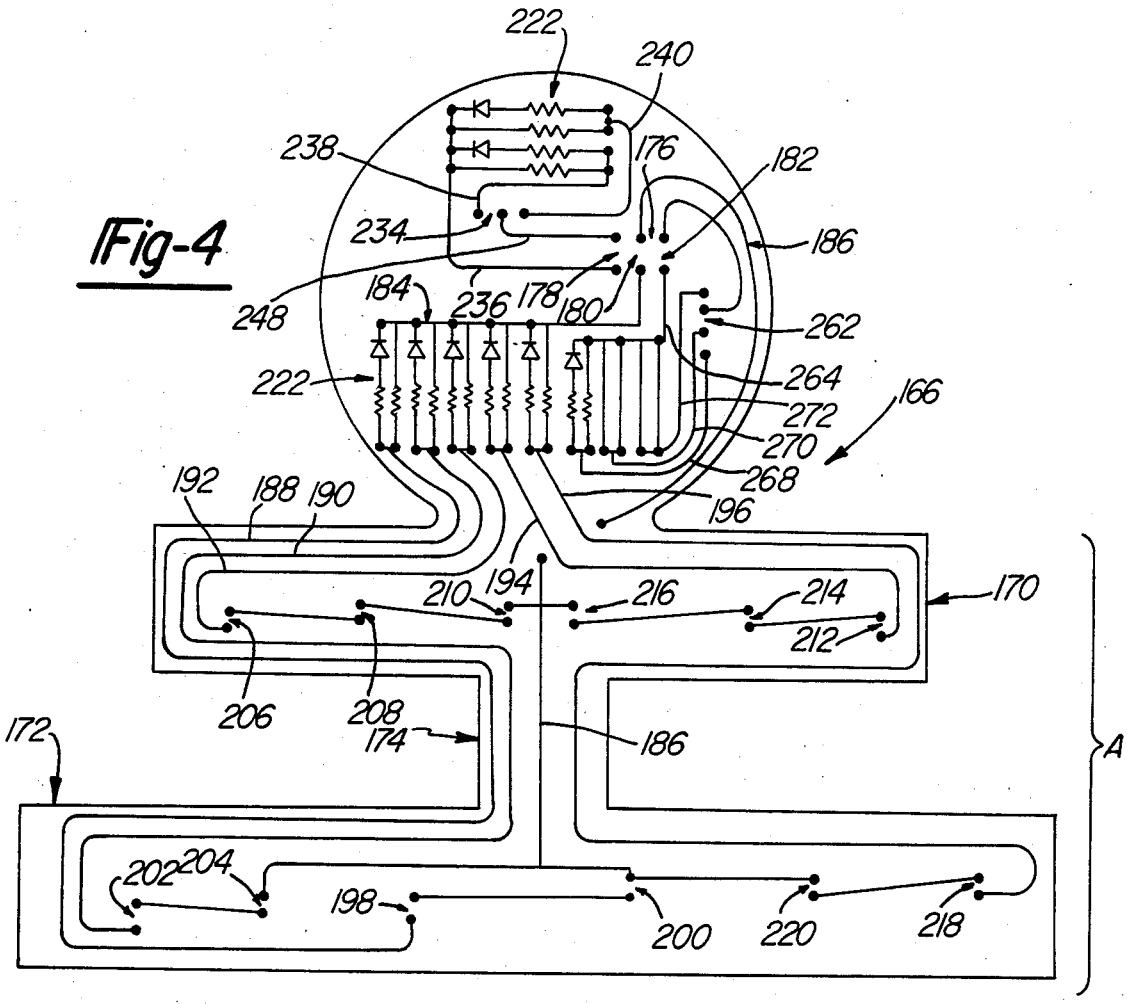
FIGS. 4, 5 and 6 are developed views of printed circuit members for use with the invention lighting assembly.

The lighting fixture of FIGS. 1 and 2 is adapted for use with an overhead track lighting system. Specifically, the lighting fixture includes a U-shaped bracket 78 having an oblong slide member 80 secured to its upper end for sliding engagement with the guide track of a track member 82. Member 80 is configured in known manner to allow it to be placed with its long dimension extending along and within the central slot opening in the track and then twisted to its illustrated configuration where it mounts the lighting fixture for sliding movement along the track. The lower ends of bracket 78 coact with bushings 84 for swiveling securement of the bracket to the lighting fixture. Specifically, bushings 84 are internally threaded and are secured to diametrically opposed locations on main body cylindrical portion 10 by screws 86 passing through mounting holes 48. The lower ends of bracket 78 are in turn secured to the outer ends of bushings 84 by fasteners 88 passing through suitable holes in the lower ends of the bracket for threaded engagement with the outer portions of bushings 84.

A control assembly for the invention lighting assembly is seen in FIGS. 3–13. The control assembly, as seen schematically in FIG. 3, includes a remote keyboard controller 130, a main controller unit 132, an auxiliary track 134, and an adapter assembly 136. Remote keyboard controller 130 includes a housing 138 and a plurality of control buttons positioned on the upper face of the housing. A cord 42 connects controller 130 with main controller unit 132.

Main controller unit 132 includes a housing 144, a six pin connector 146 and a three pin connector 148. Three pin connector 148 is adapted to electrically plug into the standard overhead track 82 suitably secured to a ceiling or other overhead support structure and six pin connector 146 is adapted to plug electrically into auxiliary track 134.

Track 134 may be formed of a suitable plastic or aluminum material and is adapted to be mounted on the ceiling in side-by-side relation to existing track 82. Track 134 may be secured directly to the ceiling or may be secured to existing track 82. Track 134 includes an internal, downwardly opening groove 152 and an external longitudinally extending rib 154. A strip of mylar 156 is adhesively or otherwise secured to the upper boundary **152*a* of groove 152. Six etched contact strips extend in parallel longitudinal relation along mylar strip 156 for selective electrical contact with the six pins of connector 146 when main controller 132 is plugged into tracks 82 and 134**.

Adaptor assembly 136 includes an adaptor 158 and a six pin connector 160 interconnected by a cord 162. Adaptor 158 has a cross-sectional configuration which is complementary to the cross-sectional configuration of auxiliary track 154 and, specifically, includes a nose portion **158*a* for receipt in groove 152, a hook portion 158*b* adapted to hook around and slideably engage rib 154, and six pressure contacts 164 in the upper face of the adaptor for selective electrical engagement with the six contact strips of mylar strip 156. Six pin connector 160 is adapted to plug into the printed circuit board seen generally at 166 in FIG. 4**.

Printed circuit board 166 is preferably formed of mylar and includes a head portion 168, an upper strip portion 170, a lower strip portion 172, and a joinder portion 174.

Printed circuit board 166 is adapted to be adhesively secured within the lighting fixture seen in FIGS. 1 and 2 and, specifically, with head portion 168 suitably secured to partition 24, upper strip portion 170 positioned within section 10 and extending circumferentially around the inner periphery of that section, lower section 172 positioned within section 14 and extending circumferentially around the inner periphery of that section, and joinder portion 174 extending through section 12 to interconnect sections 170 and 172. Head portion 168 may be secured to the upper face of partition 24 or to the lower face of partition 24 or may be formed of a rigid material and take the place of partition 24.

The six pin connector 160 of the adaptor assembly 136 plugs into head portion 168 at the six pin connection points seen generally at 176. The six connection points 176 comprise three pairs of connection points 178, 180 and 182. Pins 178 generally control a plurality of group B lighting assemblies positioned in lighting fixture section 20; points 180 control a plurality of group A lighting assemblies positioned in lighting fixture sections 10 and 14; and points 182 control a plurality of group C lighting assemblies positioned in lighting fixture section 16.

The light assemblies of group A are controlled through contact points 180 through a drive circuit 184 and a return circuit 186. Drive circuit 184 connects with a plurality of individual drive circuits 188, 190, 192, 194 and 196. Drive circuit 188 extends between drive circuit 184 and return circuit 186 and serially interconnects sets of contact points 198 and 200 positioned in circumferentially spaced relation on lower strip 172 of printed circuit board 166. Drive circuit 190 similarly extends between drive circuit 184 and return circuit 186 and serially interconnects sets of contacts 202 and 204 positioned in circumferentially spaced relation on strip portion 172; drive circuit 192 similarly interconnects drive circuit 184 and return circuit 186 and extends serially through sets of contact points 206, 208 and 210 spaced circumferentially on strip portion 170; drive circuit 194 similarly interconnects drive circuit 184 and return circuit 186 and extends serially through sets of contact points 212, 214 and 216 circumferentially spaced on strip portion 170; and drive circuit 196 similarly interconnects drive circuit 184 and return circuit 186 and extends serially through sets of contact points 218 and 220 spaced circumferentially on strip portion 172.

Figure 7:
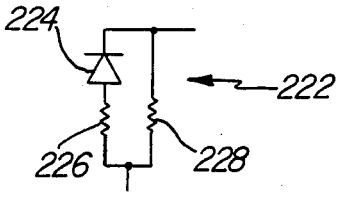
FIG. 7 is a detail view of a control circuit employed in the printed circuit member of FIG. 4.

A parallel control circuit 222, best seen in FIG. 7, is provided between drive circuit 184 and each of drive circuits 188, 190, 192, 194 and 196.

Each control circuit 222 includes a first parallel branch having a rectifier diode 224 and a resistor 226 and a second parallel branch having a resistor 228.

Figure 5:
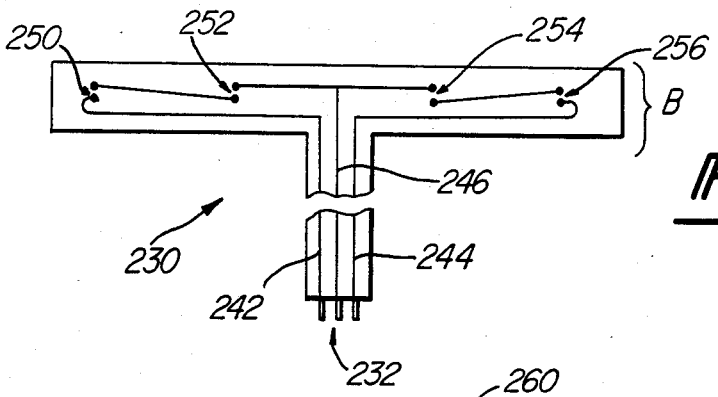

The light assemblies of group B are controlled by mylar circuit board 230 as seen in FIG. 5. Mylar circuit board 230 includes three pins 232 which plug into pin contacts 234 in head portion 168 of circuit board 166. In use, mylar circuit board 230 extends upwardly from head portion 168 and is adhesively secured in circumferential relation to the inner surface of upper lighting fixture housing section 20.

Circuit board 230 is controlled by contacts 178 on head portion 168. A drive circuit 236 extends through a pair of control circuits 222 to drive circuits 238 and 240 which in turn connect through pins 232 with drive circuits 242 and 244 on circuit board 230 and the central pin of pins 232 connects a return circuit 246 on circuit board 230 with a return circuit 248 on head portion 168. Drive circuit 242 will be seen to extend through circumferentially spaced sets of contacts 250 and 252 on circuit board 230 and drive circuit 244 will be seen to extend through circumferentially spaced sets of contact points 254 and 256 on circuit board 230.

Figure 6:
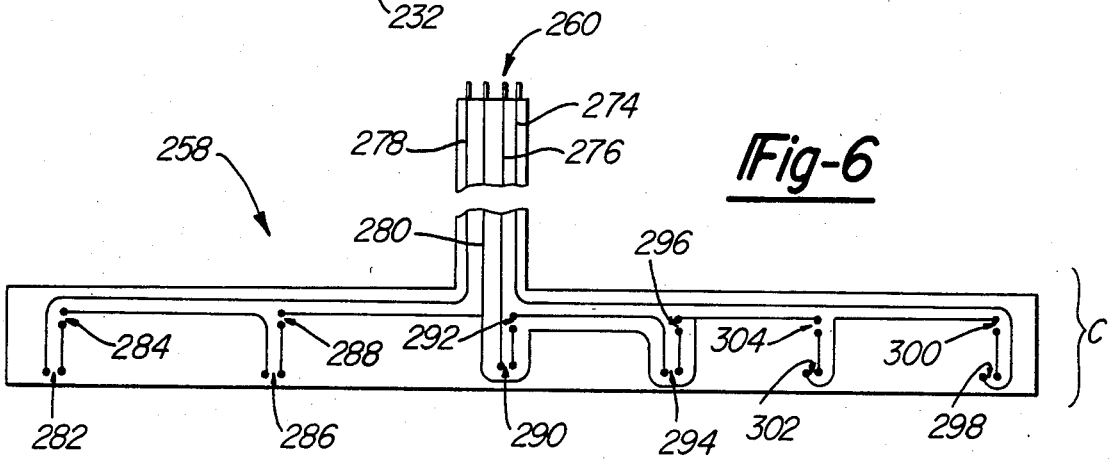

The light assemblies of group C are controlled by circuit board 258 seen in FIG. 6. Circuit board 258 includes four pins 260 adapted to be plugged into the four pin contacts seen at 262 on head portion 168 of circuit board 166. In use, circuit board 258 is adhesively secured in circumferential relation to the inner surface of lower lighting fixture housing section 16.

Circuit board 258 is controlled by contact 182 on head portion 168 through a drive circuit 264 and a return circuit 266. Three drive circuits 268, 270 and 272 are connected to drive circuit 264 by a respective control circuit 222 and interconnect through pin contacts 262 and 260 with respective drive circuits 274, 276 and 278 on printed circuit board 258. A return line 280 on circuit board 258 interconnects through contacts 260 and 262 with return circuit 266 on head portion 168. Drive circuit 278 will be seen to extend serially through circumferentially spaced sets of contact points 282, 284, 286 and 288; drive circuit 276 will be seen to extend serially through circumferentially spaced sets of contact points 290, 292, 294 and 296; and drive circuit 274 will be seen to extend serially through circumferentially spaced sets of contact points 298, 300, 302 and 304.

Figure 8:
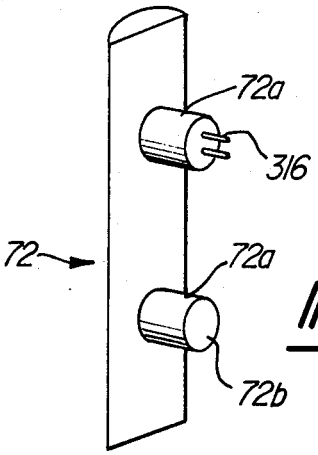
FIG. 8 is a perspective view of a light element for use with the invention lighting assembly.

FIG. 8 is a detailed perspective view of one of the ribs 72 positioned on the exterior surface of housing section 20. Each rib 72 is formed of a suitable translucent material and includes a plurality of integral mounting lug portions **72*a* for passage through vertically spaced openings on the housing section 70** to position the rib vertically on the exterior surface of the housing section with the lugs passing through the wall of the housing section and terminating at a location generally corresponding to the inner surface of the housing section.

Figure 9:
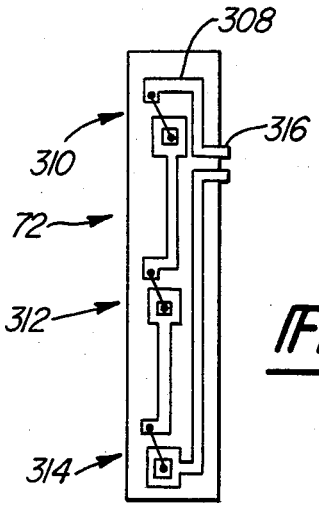
FIG. 9 is a printed circuit for use with the light element of FIG. 8.
Figure 11:
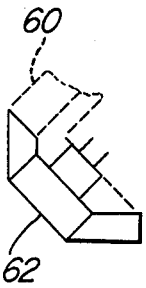
FIG. 11 is a view of a further light element for use with the invention lighting assembly.

With reference to FIG. 9, a printed circuit or lead frame seen generally at 308 is embedded within each rib 72 and each lead frame includes one or more tricolor LEDs. For example, the lead frame 308 may include three vertically spaced LEDs 310, 312 and 314. LEDs 310, 312 and 314 are of the type which glow red upon energization with DC current, green upon energization with reverse DC current, and yellow upon energization with AC current. Lead frame 308 terminates in external pins 316 which protrude from upper lug **72*a* of rib 72 for coaction with a respective set of pin contacts on printed circuit 230. The inner surface 72*b* of each lug 72*a* is preferably suitably rendered opaque to avoid dilution of the LED emitted light by the light from bulb 34**.

As noted, the particular rib 72 seen in FIG. 8 with the particular lead frame seen in FIG. 9 embedded therein is specifically designed for use with contact sets 250, 252, 254 and 256 of printed circuit 230 so that four ribs 72 may be positioned circumferentially around upper housing section 20 with lug portions **72*a* projecting through suitable pairs of vertically spaced openings in housing section 20 and pins 316 passing through respective sets of contact points 250, 252, 254 and 256 on printed circuit 230 to provide a plurality of ribs 72** comprising the lighting assemblies of group B.

Figure 10:
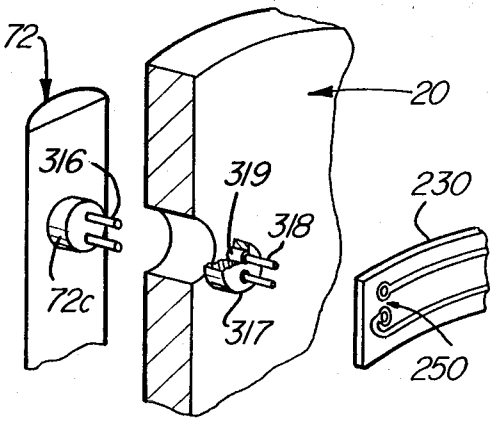
FIG. 10 is a view showing an alternate method of mounting the light element of FIG. 8 to the housing assembly.

Similar ribs 40 with similar lead frames embedded therein are provided for coaction with contact points 206, 208, 210, 212, 214 and 216 on printed circuit strip portion 170 positioned circumferentially within housing section 10; similar ribs 54 with similar lead frames embedded therein are provided for coaction with contact points 202, 204, 198, 200, 220 and 218 on printed circuit strip portion 172 positioned circumferentially within housing section 14; similar ribs 60 with similar lead frames embedded therein are provided for coaction with contact points 284, 288, 292, 296, 300, and 304 on printed circuit board 258 positioned circumferentially within lower conical housing section 16; and angled corner ribs 62, seen in detail in FIG. 10, are provided with suitable lead frames and coact with contact points 282, 286, 290, 294, 298 and 302 on printed circuit board 258.

The ribs associated with upper and lower strip portions 170 and 172 on printed circuit 166 comprise the group A lighting assemblies and the ribs associated with printed circuit 258 comprise the group C lighting assemblies.

The ribs 72 and 54 positioned respectively on housing sections 20 and 14 preferably include an embedded lead frame including three tricolor LEDs; the ribs 40 and 60 positioned respectively on housing sections 10 and 16 preferably include a lead frame including two tricolor LEDs; and the corner ribs 62 preferably include a lead frame including only one tricolor LED.

An alternative arrangement for connecting the various ribs to the various sets of contact points on the printed circuits is seen in FIG. 10. In this alternative arrangement, as illustrated in connection with ribs 72, the lug portion **75*c* is foreshortened as compared to lug portion 72*a* and an interconnector 317, formed of plastic, is interposed between lug portion 72*c* and printed circuit 230. Interconnector 317 includes pins 318 for coaction with the sets of contact points and sockets 319 for plug-in receipt of pins 316 on lug portion 72*c*. The combined thickness of a lug portion 72c and an interconnector 317 generally equals the thickness of the related housing section so that the inner face of each interconnector 317 is generally flush with the inner surface of the housing section. The arrangement of FIG. 10 allows the interconnectors 317 to be plugged into the respective sets of contact points on the respective printed circuits whereafter the interconnector pins 318 may be quickly, effectively, and inexpensively electrically connected to the respective contact points by passing the printed circuits and interconnectors over the surface of a shallow bath of molten solder. The interconnected printed circuits and interconnectors may now be positioned within the respective housing sections to position the interconnectors in the respective holes in the respective housing sections, whereafter the lug portions of the respective ribs may be positioned in the housing section holes to plug pins 316 into sockets 319**.

Figures 12, 13:
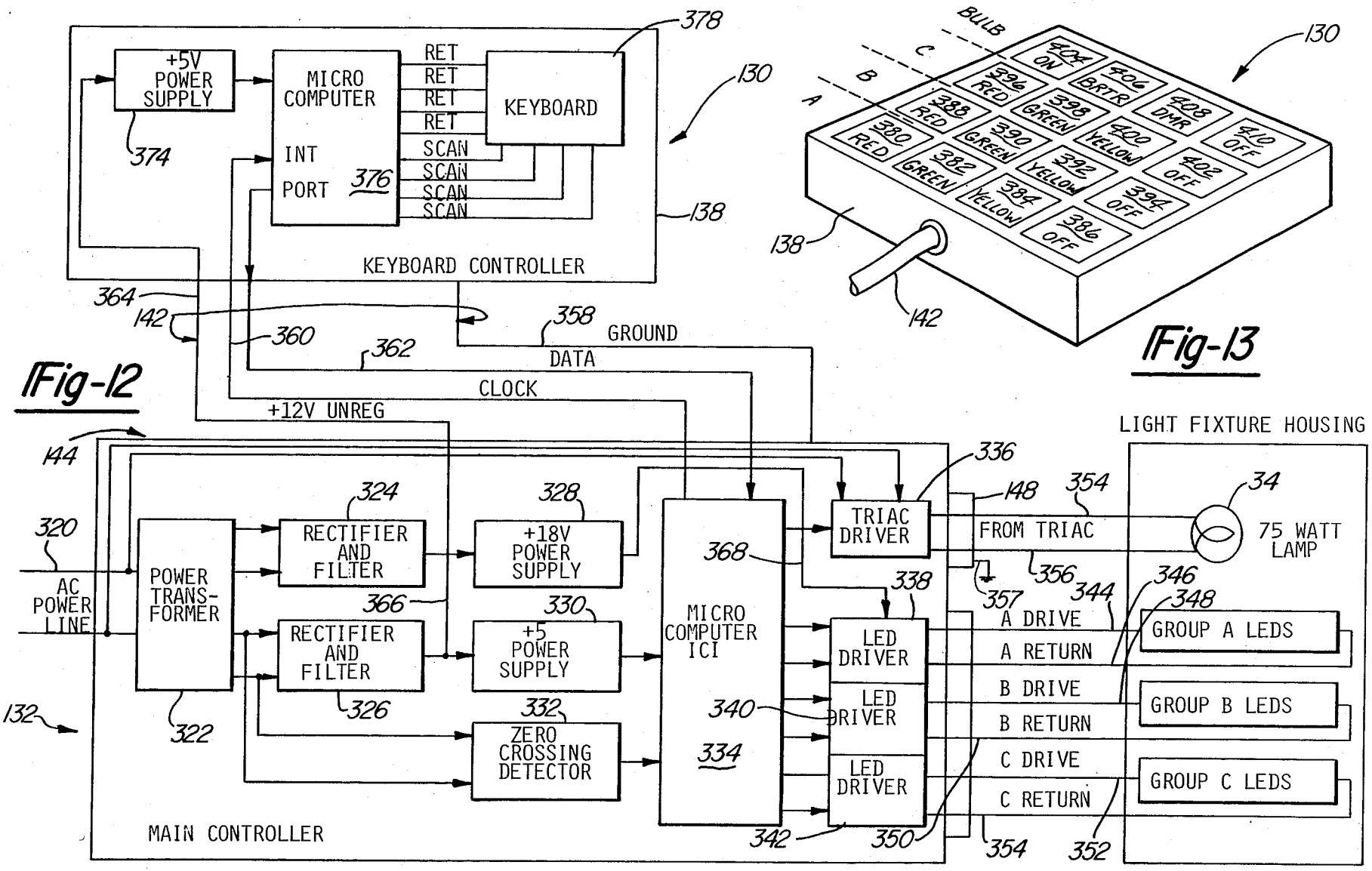
FIG. 12 a block diagram of the control assembly shown schematically in FIG. 3.
FIG. 13 is a fragmentary perspective view of a remote keyboard controller for use in the control assembly of FIG. 12.

The control assembly for the invention lighting assembly is seen in block diagram in FIG. 12. The control assembly of FIG. 11 functions to control the intensity of incandescent bulb 34 and functions to independently energize the LEDs of light assembly groups A, B and C to provide red, green or yellow lighting for the ribs comprising the respective light element groups.

The control assembly includes the main controller 132 and keyboard controller 130.

Main controller 132, in addition to housing 144, includes a power supply 320; a power transformer 322; a pair of rectifiers and filters 324 and 326; an 18-volt power supply 328; a 5-volt power supply 330; a zero crossing detector 332; a microcomputer 334; a triac driver 336; and three LED drivers 338, 340 and 342.

Six pin connector 146 includes a drive line 344 controlling the LEDs of light element group A; a return line 346 for light group A; a drive line 348 controlling light group B; a return line 350 for light group B; a drive line 352 controlling light group C; and a return line 354 for light group C.

Three pin connector 148 includes drive and return lines 354 and 356 controlling incandescent lamp 34 and a ground line 357.

Cable 142 between main controller 132 and keyboard module 130 includes four wires. Wire 358 is a ground wire for power return and signal reference; wire 360 is a clock wire; wire 362 is a data wire; and wire 364 is a 12-volt unregulated wire.

Transformer 322 has two secondary windings which are rectified and filtered separately by rectifier and filter 324 and rectifier and filter 326 respectively. Rectifier and filter 324 develops a raw 21-volt DC voltage and rectifier and filter 326 develops a raw 8-volt DC voltage. The 8-volt output of unit 326 is brought out to 8-volt unregulated wire 364 via wire 366. Eight-volt output of unit 326 is also supplied to power supply 330 where it is regulated to 5 volts. The 5-volt output of unit 330 powers microcomputer 334 and its peripheral circuitry. The 24-volt raw DC voltage from unit 324 is brought out to unit 328. Unit 328 is an integrated regulator which provides 18 volts from the unregulated 24 volts delivered to it. This 18-volt power supply output is used to power the LED drivers 338, 340 and 342 via line 368.

The AC power line is brought out to triac driver 336 via lines 370 and 372. Triac driver 336 switches the AC line input to lamp 34. The microcomputer 334 controls the trigger point of the triac 336 in time relative to the zero crossings of the AC line. Triggering the triac very soon after the zero crossing will cause the lamp to glow brightly because the triac will conduct for most of the subsequent half cycle of the AC line. Triggering the triac later (but not as late as the next half cycle) will cause the lamp to glow dimmer. This timing is controlled by the software algorithm internal to microcomputer 334. Zero crossing information is supplied to microcomputer 334 by zero crossing detector 332. Microcomputer 334 is interrupted by zero crossing detector 332 whenever the AC line voltage approaches zero volts, giving microcomputer 334 a timing reference from which it can start a delay before triggering triac driver 336.

Keyboard controller 130 includes a power supply 374, a microcomputer 376, and a keyboard 378 all housed in keyboard controller housing 138.

Keyboard controller 130 receives 8 volts unregulated power from line 364. The 8 volts unregulated power is then reduced to 5 volts by power supply 374 and regulated to produce the logic power supply for keyboard 378.

Keyboard 378 performs the operator interface function. Commands are entered using a 16-key keyboard, best seen in FIG. 12, with four keys associated respectively with the group A LEDs of the lighting fixture; the group B LEDs of the lighting fixture; the group C LEDs of the lighting fixture; and the incandescent lamp of the lighting fixture. Specifically, key 380 energizes the group A LEDs in a sense to produce red light in the ribs comprising group A; key 382 energizes the group A LEDs in a sense to produce green lighting; key 384 energizes the group A LEDs in a sense to produce yellow light; and key 386 turns off the group A LEDs. Similarly, key 388 energizes the group B LEDs in a sense to produce red light; key 390 energizes the group B LEDs in a sense to produce green light; key 392 energizes the group B in a sense to produce yellow light; and key 394 turns off the group B LEDs. Similarly, key 396 energizes the group C LEDs in a sense to produce red light; key 398 energizes the group C LEDs in a sense to produce green light; key 400 energizes the group C LEDs in a sense to produce yellow light; and key 402 turns off the group C LEDs. Key 404 turns on bulb 34; key 406 causes bulb 34 to burn brighter; key 408 causes bulb 34 to burn dimmer; and key 410 turns off lamp 34.

Additional keys may be added as desired to keyboard 378 to provide additional functions such as selectively varying the brightness or intensity of the LEDs in the various light groups.

OPERATION

The described lighting fixture assembly will be seen to provide the operator with the ability to precisely and selectively actuate the various lighting assemblies on the lighting fixture in a manner to selectively produce a variety of visual effects. Specifically, by selective depression of the various keys of keyboard 378, the ribs comprising the group A lighting assemblies may be caused to glow with either a red, a green, or a yellow effect; the group B lighting assemblies may also separately and selectively be caused to glow with a red, a green, or a yellow effect; and the group C lighting assemblies may also be separately and selectively caused to glow with a red, a green, or a yellow effect. Further, the bulb 34 may be caused to glow with whatever intensity is desired as a compliment to the particular colored lighting effect being produced at the various light group assemblies. To produce the green effect at any given light group, the system functions to deliver forward DC current to the LEDs associated with that light group; to produce the red effect, the system functions to deliver reverse DC current to the associated LEDs; and to produce the yellow effect, the system functions to deliver alternating current to the associated LEDs.

It will be understood that in each case the signal from the keyboard 378 is transmitted via cable 142 to the command module 144 which is plugged into the main track 82 and auxiliary track 134 by pin connectors 148 and 146 and which is receiving power through cable 320. The six pins of pin connector 146 correspond to lines 344, 346, 348, 350, 352 and 354 extending respectively from LED drivers 338, 340 and 342 of the main controller and the three pins of pin connector 148 correspond to the three lines 354, 356 and 357 extending from the triac driver 336 of the main controller. The power transmitted through lines 354 and 356 is transmitted in known manner along main track 82, picked up by a suitable adapter 80 received within track 82, and then transmitted via cable 412 to a plug 414 which is in suitable electrical contact with bulb 34. Pins 334–354 plug into the ends of mylar strip 156 which is adhesively secured within groove 152 of auxiliary track 134. Pins 344–354 thus make respective electrical contact with the six parallel electrical circuits etched on mylar strip 156 and these six strips in turn respectively communicate with respective pressure contacts 164 on adapter 158. Cord 162 extending between adapter 158 and plug 160 contains six wires corresponding to the drive for the group A LEDs, the return for the group A LEDs, the drive for the group B LEDs, the return for the group B LEDs, the drive for the group C LEDs, and the return for the group C LEDs.

Plug 160 lugs into contact sets 176 on circuit board 168 and, specifically, the drive and return pins on plug 160 corresponding to light group A plug into contact sets 180; the set of pins on plug 160 corresponding to light group B plug into contact sets 178; and the set of pins on plug 160 corresponding to light group C plug into contact set 182. The printed circuit boards 166, 230 and 258 provide a resistance in series with each LED string in order to limit the current to the LEDs to under the rated value. The resistance is different for current flowing forward than for reverse current since the LED strings have a larger voltage drop when energized green than when energized red. A voltage drop across the circuit board of about six volts is appropriate so that minor voltage fluctuations in the supply and load will not cause significant current variations. The forward current flows in each case from a drive terminal through the circuit board to the appropriate LED load. The reverse current flows in the opposite sense. Forward current will flow only through resistance 228 since it is blocked by diode 224. Reverse current flows through both parallel resistances 226 and 228. This results in an effective resistance corresponding to the parallel combination resistance of 226 and 228. The LEDs in each case are of the multi-color variety. They consisted of a red and a green LED both mounted within and illuminating the same rib. They are connected cathode of the red LED and anode of the green LED to one lead and the other lead connected to the cathode of the green LED and the anode of the red LED. The net effect is that the device illuminates red for current in one direction and green for current in the opposite direction. The LEDs may, for example, be of the type available from National Semiconductor Corp. of Santa Clara, Calif. as LED Lamp Item No. XC-5491.

In the described preferred embodiment, four ribs 72 are vertically arranged on housing section 20 in circumferentially spaced relation to comprise light group B; six ribs 40 are vertically arranged on housing section 10 in circumferentially spaced relation and six ribs 54 are vertically arranged on housing section 14 in circumferentially spaced relation and coact with the six ribs on housing section 10 to comprise light group A; and six ribs 60 are vertically arranged on housing section 16 in circumferentially spaced relation and six corner ribs 62 are positioned on the lower edge of housing section 16 in alignment with the respective ribs 60 and coact with the associated ribs 60 to comprise light group C. The described arrangement allows an operator positioned remotely from the lighting fixture to selectively and precisely select the lighting effect desired included a totally red effect; a totally green effect; a totally yellow effect; mixtures of the above effect constituting the various combinations of light groups A, B and C; and further combinations derived by variations in the use of light bulb 34.

ALTERNATIVE CONTROL ASSEMBLIES

Figure 14:
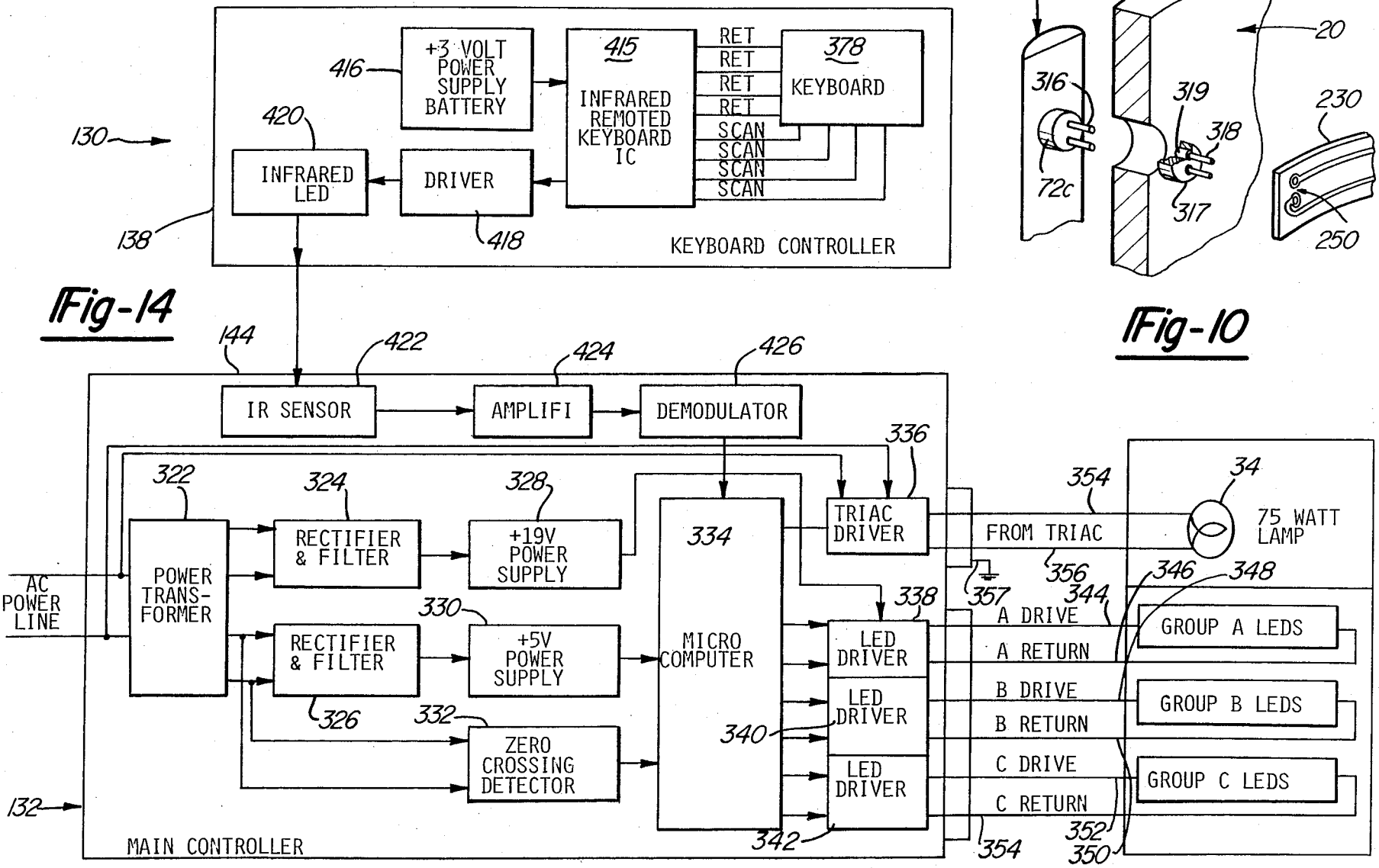
FIGS. 14, 15 and 16 are block diagrams of alternative control assemblies for use with the invention lighting assembly.

Other control assemblies may be used to control the invention lighting fixture. Thus, with reference to FIG. 14, a control assembly utilizing a infrared signal is disclosed. This control assembly corresponds in most respects with the wired control assembly of FIG. 12 with the exception that the signal from the keyboard module 130 in this case is transmitted to the main controller 132 via an infrared arrangement. Specifically, microcomputer 376 is replaced by a remote keyboard IC 415 powered by a 3-volt battery power supply 416 and the output of IC 415 is delivered to a driver 418 and from there to an infrared LED 420. Infrared LED 420 transmits an infrared signal in known manner to an infrared sensor 422 positioned within housing 144 of main controller 132. The output of infrared sensor 422 is delivered to an amplifier 424 and thence to a demodulator 426. The output of demodulator 426 is then delivered to the microcomputer 334 of the main controller. The main controller corresponds in all other respects to the control assembly previously described in FIG. 12.

Figure 15:
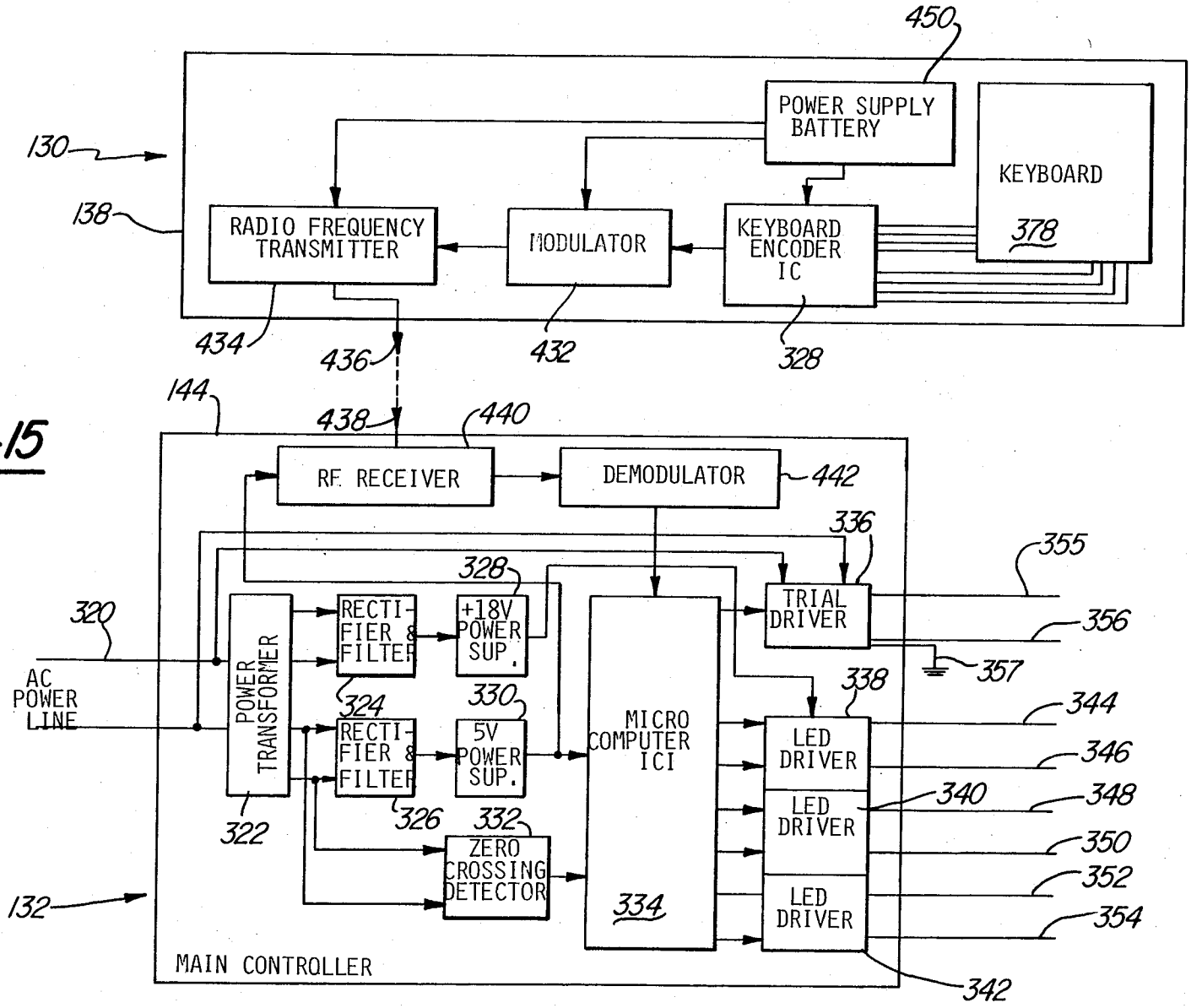

A further alternative control assembly is illustrated in FIG. 15 wherein a keyboard encoder integrated circuit 428 is powered by a battery supply 430 and delivers its output to a modulator 432 which in turn outputs to a radio frequency transmitter 434. Transmitter 434 outputs through an antenna 436 to a receiving antenna 438 positioned on main controller 132. The signal received on antenna 438 is inputted to a radio frequency receiver 440 powered by 5 volts delivered from power supply 330. Receiver 440 in turn outputs to a demodulator 442 which outputs to microcomputer 334. The other elements of the main controller correspond substantially to the similar elements of the control assemblies of FIGS. 12 and 14.

Figure 16:
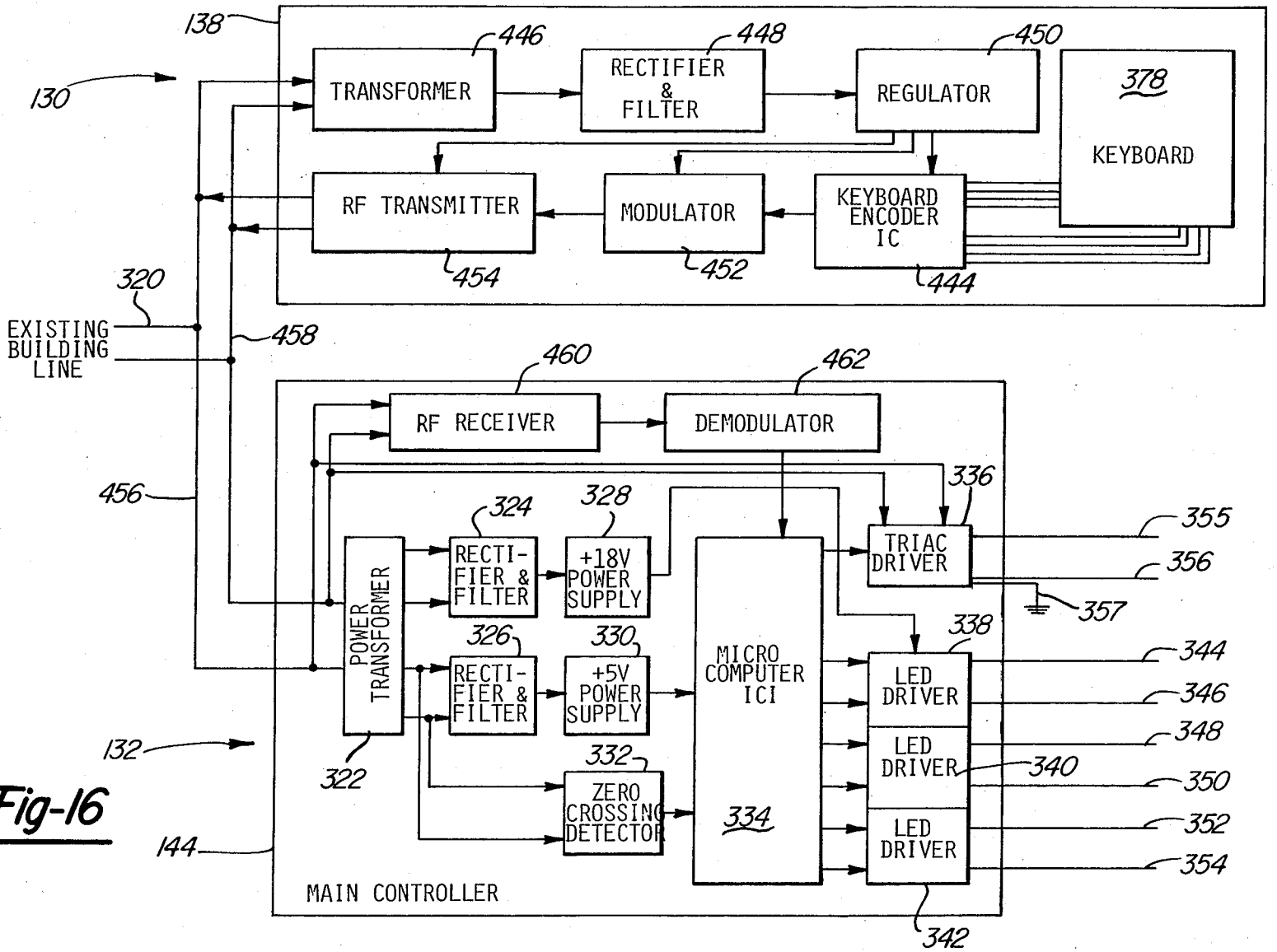

A further alternative control assembly is shown in FIG. 16 wherein a carrier current operated system is disclosed. In this assembly, the output of the keyboard controller 130 is superimposed on and delivered to the main controller via the existing residential wiring system. Specifically, keyboard encoder 444 is powered through a transformer 446, a rectifier and filter 448, and a regulator 450, all housed within the housing 138 of the keyboard controller, and outputs to a modulator 452 which in turn outputs to a radio frequency transmitter 454. Modulator 452 and radio frequency transmitter 454 are both powered through transformer 446, rectifier and filter 448, and regulator 450. The output of transmitter 454 is delivered to existing residential wires 456 and 458 which deliver the output signal from the transmitter via lines 462 and 464 to a radio frequency receiver 460 positioned within the housing 144 of main controller 132. The output of radio receiver 460 is in turn delivered to demodulator 462 which outputs to microcomputer 334. The remaining elements of the control assembly of FIG. 16 correspond substantially to the similar elements of the control systems described with reference to FIGS. 12, 14 and 15.

Whereas preferred embodiments of the invention have been illustrated and described in detail, it will be apparent that various changes may be made in the disclosed embodiments without departing from the scope or spirit of the invention.

We claim:

1. A lighting assembly comprising:

A. a hollow, elongated housing open at one end and adapted to be supported at its other end;

B. means within said housing for mounting a lightbulb socket adjacent said other end generally on the central longitudinal axis of said housing and extending within said housing toward said one open end;

C. a plurality of light element assemblies arranged on the exterior of said housing; and D. means for selectively energizing each of said light element assemblies in a manner to cause the assemblies to selectively emit a plurality of different colored lighting effects.

2. A lighting assembly according to claim 1 wherein:

E. said light element assemblies are operative to emit a different colored lighting effect in response to variations in the aspect of the electric energy delivered to the assembly; and F. said energizing means comprises means for delivering electrical energy to said light element assemblies in varying aspects.

3. A lighting assembly according to claim 2 wherein:

G. said energizing means further includes means for delivering electrical energy to said lightbulb socket in varying intensities.

4. A lighting assembly according to claim 2 wherein:

G. said light element assemblies each include a light transmitting element positioned on the exterior of said housing and at least one light emitting diode embedded in said light transmitting element.

5. A lighting assembly according to claim 4 wherein:

H. said light transmitting elements includes lug portions extending through said housing to mount the light transmitting element on the housing; and I. said energizing means include leads extending from the interior of said housing and through said lug portions for electrical connection with said light emitting diodes.

6. A lighting assembly according to claim 4 wherein:

H. the light transmitting element of each light element assembly comprises a rib arranged vertically on the exterior of the housing and the ribs of the various light element assemblies are arranged in circumferentially spaced relation about the housing; and I. a plurality of light emitting diodes are provided for coaction with each rib at vertically spaced locations therealong.

7. A lighting assembly according to claim 4 wherein:

H. each light emitting diode is a multicolor light emitting diode operative to emit varying colors in response to variations in the aspect of the electrical energy delivered to it by said energizing means.

8. A lighting assembly according to claim 7 wherein:

I. each light emitting diode is a tri-color light emitting diode responsive to energizing by a direct current to emit a first color, responsive to energizing by a reverse direct current to emit a second color, and responsive to energizing by an alternating current to emit a third color; and J. said energizing means comprises means for selectively delivering direct current, reverse direct current, and alternating current to said light emitting diodes.

9. A lighting assembly according to claim 2 wherein:

G. a plurality of groups of light element assemblies are provided on the exterior of the housing;

H. said lighting fixture further includes an overhead track and an adapter associated with said other end of said housing and mounted for axial movement along said track; and I. said energizing means includes 1. a plurality of electrical contact strips extending longitudinally along said track,
2. a like plurality of electrical contact elements on said adapter arranged to electrically contact the respective contact strips,
3. means electrically connecting said contact elements with respective groups of said light element assemblies, and
4. track energizing means operative to energize a selected combination of said contract strip to deliver a selected aspect of electrical energy to a selected group of said light element assemblies.

10. A lighting assembly according to claim 9 wherein:

J. said track energizing means comprises 1. a remote control device adapted to be positioned remote from the lighting fixture, and
2. delivery means operative in response to actuation of said remote control device to deliver a selected aspect of electrical energy to a selected combination of said contact strips.

11. A lighting assembly according to claim 10 wherein:

K. said delivery means includes electrical conductors extending between said remote control device and said track.

12. A lighting assembly according to claim 10 wherein:

K. said delivery means includes a transmitter associated with said remote control device and a receiver associated with said track.

13. A lighting assembly according to claim 12 wherein:

L. said transmitter comprises a radio frequency transmitter.

14. A lighting assembly according to claim 13 wherein:

M. said radio frequency transmitter is part of a carrier current operated system and the output of said transmitter is carried on the existing wires of the associated building structure.

15. A lighting assembly according to claim 12 wherein:

L. said transmitter comprises an infrared transmitter.

16. A lighting assembly comprising:

A. an overhead track;

B. a housing;

C. an adapter associated with an upper portion of said housing and received in said track so as to mount said housing for selective axial positioning along said track;

D. a light emitting assembly mounted on said housing and operative in response to receipt of electrical energy in selected disparate aspects to respectively emit disparate components of the visible light spectrum;

E. a remote control device; and

F. means operative to transmit electrical energy in disparate aspects from said remote control device to said light emitting assembly via said track and said adapter to thereby remotely and selectively cause said light emitting assembly to emit disparate aspects of the visible light spectrum.

17. A lighting assembly according to claim 16 wherein:

G. said transmitting means includes 1. a plurality of contact strips extending along said track;
2. a plurality of contacts on said adapter respectively contacting said contact strips,
3. means for selectively energizing selected combinations of said strips and thereby selected combinations of said contacts, and
4. means for conducting electrical energy from the respectite energized contacts of said adapter to said light emitting assembly.

18. A lighting assembly according to claim 17 wherein:

H. said conducting means comprises electrical conductors extending from said adapter to said light emitting assembly.

19. A lighting assembly according to claim 18 wherein:

I. a plurality of said light emitting assemblies are mounted at spaced locations on the exterior surface of said housing; and J. said electrical conductors are provided at least in part by printed circuit boards secured to the interior surface of said housing and presenting sets of electrical contacts on said interior surface in opposition to the respective light emitting assemblies positioned in said exterior surface.

20. A lighting assembly according to claim 19 wherein:

I. said light emitting assembly includes 1. translucent member mounted on the exterior of said housing, and
2. a light emitting diode embedded in said translucent member; and J. said electrical conductors extend from said adapter to said light emitting diode.

21. A lighting assembly according to claim 20 wherein:

I. said light emitting diode is a tri-color light emitting diode; and

J. said transmitting means is operative to transmit direct current, reverse direct current, and alternating current to said diode through said electrical conductors in response to selective actuation of said remote control device.

* * * * *